US012758827B2

(12) United States Patent
Chiu

(10) Patent No.: US 12,758,827 B2
(45) Date of Patent: Oct. 13, 2026

(54) FITNESS DEVICE AND RESISTANCE ADJUSTMENT METHOD THEREOF

(71) Applicant: INVENTEC APPLIANCES CORPORATION, New Taipei City (TW)

(72) Inventor: Ta-Chou Chiu, New Taipei City (TW)

(73) Assignee: INVENTEC APPLIANCES CORPORATION, New Taipei City (TW)

( * ) Notice: Subject to any disclaimer, the term of this patent is extended or adjusted under 35 U.S.C. 154(b) by 43 days.

(21) Appl. No.: 19/097,812

(22) Filed: Apr. 1, 2025

(65) Prior Publication Data

US 2026/0166382 A1 Jun. 18, 2026

(30) Foreign Application Priority Data

Dec. 16, 2024 (TW) ..... 113148844

(51) Int. Cl.
*A63B 24/00* (2006.01)
*A63B 21/00* (2006.01)
*A63B 21/055* (2006.01)

(52) U.S. Cl.
CPC .... *A63B 24/0087* (2013.01); *A63B 21/00076* (2013.01); *A63B 21/0552* (2013.01);
(Continued)

(58) Field of Classification Search
CPC ..... A63B 21/00076; A63B 21/0552; A63B 24/0087; A63B 2024/0009;
(Continued)

(56) References Cited

U.S. PATENT DOCUMENTS 11,161,012 B1 * 11/2021 Hendricks ..... A63B 21/0058
11,235,195 B2 * 2/2022 Gregory ..... A63B 21/4033
(Continued)

FOREIGN PATENT DOCUMENTS

CN 108159632 A 6/2018
CN 115253215 A * 11/2022 ..... A63B 24/0087
(Continued)

*Primary Examiner* — Gary D Urbiel Goldner
(74) *Attorney, Agent, or Firm* — Li & Cai Intellectual Property Office

(57) ABSTRACT

A fitness device and a resistance adjustment method thereof. The fitness device includes an exercise assembly and at least one damping module. The damping module includes a pull rope, a resistance source, a linear displacement sensor, a resistance sensor, and a processor. The resistance source is configured to output an output resistance according to a target resistance setting value and to control a stretching length of the pull rope. The linear displacement sensor is operable to sense the stretching length to generate a linear displacement sensing signal. The resistance sensor is operable to sense the output resistance to generate a resistance sensing signal. The processor is operable to calculate an exercise frequency according to the linear displacement sensing signal and the resistance sensing signal, and the processor is operable to compare the exercise frequency and a predetermined exercise frequency to control the output resistance of the resistance source.

11 Claims, 7 Drawing Sheets

(52) U.S. Cl.
CPC ... *A63B 2024/0009* (2013.01); *A63B 2220/20* (2013.01); *A63B 2220/40* (2013.01); *A63B 2220/62* (2013.01)

(58) Field of Classification Search
CPC ..... A63B 2024/0093; A63B 2220/17; A63B 2220/20; A63B 2220/30; A63B 2220/40; A63B 2220/62
See application file for complete search history.

(56) References Cited

U.S. PATENT DOCUMENTS 12,239,875 B2 * 3/2025 Gregory ..... A63B 21/0059
2014/0038777 A1 * 2/2014 Bird ..... A63B 23/03525 482/5
2018/0021616 A1 * 1/2018 Orady ..... A63B 21/16 482/5
2021/0339078 A1 * 11/2021 Akeel ..... A63B 21/00076
2024/0374962 A1 * 11/2024 Chen ..... A63B 24/0087
2024/0382807 A1 * 11/2024 Lee ..... A63B 24/0087
2025/0050158 A1 * 2/2025 Lee ..... A63B 21/153
2025/0195946 A1 * 6/2025 Wei ..... A63B 23/12
2025/0195952 A1 * 6/2025 Chiu ..... A63B 24/0062

FOREIGN PATENT DOCUMENTS

CN 115337597 A 11/2022
KR 20230050206 A * 4/2023 ..... A63B 21/153
TW I842658 B 5/2024
TW 202525384 A * 7/2025 ..... A63B 21/153

* cited by examiner

FITNESS DEVICE AND RESISTANCE ADJUSTMENT METHOD THEREOF

CROSS-REFERENCE TO RELATED PATENT APPLICATION

This application claims the benefit of priorities to Taiwan Patent Application No. 113148844, filed on Dec. 16, 2024. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a fitness device and a resistance adjustment method thereof, and more particularly to a fitness device and a resistance adjustment method thereof that can automatically adjust resistance according to the user's motion status.

BACKGROUND OF THE DISCLOSURE

A conventional fitness device (e.g., fitness pump) is a type of home fitness equipment. A working principle of the conventional fitness device is to use a resistance source (e.g., tension motor) to output a set torque to drag a pull rope to provide resistance for exercise, which can be used to train muscles throughout the body with the help of various movements.

However, a training weight of the conventional fitness device can only be set intuitively by a user in advance, and an intensity of the weight training cannot be adjusted according to the actual strength of the user during the training process.

SUMMARY OF THE DISCLOSURE

In order to solve the above-mentioned problems, one of the technical aspects adopted by the present disclosure is to provide a fitness device and resistance adjustment method thereof. The fitness device includes an exercise assembly and at least one damping module. The at least one damping module is connected to the exercise assembly. The damping module includes a pull rope, a resistance source, a linear displacement sensor, a resistance sensor, and a processor. One end of the pull rope is connected to the exercise assembly. The resistance source is connected to another end of the pull rope. The resistance source is configured to output an output resistance according to a target resistance setting value and control a stretching length of the pull rope. The linear displacement sensor is electrically coupled to the resistance source. The linear displacement sensor is operated to sense the stretching length of the pull rope for generating a linear displacement sensing signal. The resistance sensor is electrically coupled to the resistance source. The resistance sensor is operated to sense the output resistance of the resistance source to generate a resistance sensing signal. The processor is electrically coupled to the resistance source, the linear displacement sensor, and the resistance sensor. The processor is operated to calculate an exercise frequency according to the linear displacement sensing signal and the resistance sensing signal, and the processor is operated to compare the exercise frequency and a predetermined exercise frequency to control the output resistance of the resistance source.

In order to solve the above-mentioned problems, another one of the technical aspects adopted by the present disclosure is to provide a resistance adjustment method of a fitness device. The fitness device includes an exercise assembly and at least one damping module that is connected to the exercise assembly. The damping module includes a pull rope, a resistance source that is connected to the pull rope, a linear displacement sensor that is electrically coupled to the resistance source, a resistance sensor that is electrically coupled to the resistance source, and a processor that is electrically coupled to the resistance source, the linear displacement sensor, and the resistance sensor. The resistance source is configured to output an output resistance according to a target resistance setting value and control a stretching length of the pull rope. The resistance adjustment method includes the following steps: a measuring step that is implemented to sense the stretching length of the pull rope to generate a linear displacement sensing signal by the linear displacement sensor and sense the output resistance of the resistance source to generate a resistance sensing signal by the resistance sensor; a calculating step that is implemented to calculate an exercise frequency according to the linear displacement sensing signal and the resistance sensing signal by the processor; and an adjusting step that is implemented to compare the exercise frequency and a predetermined exercise frequency to control the output resistance of the resistance source by the processor.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
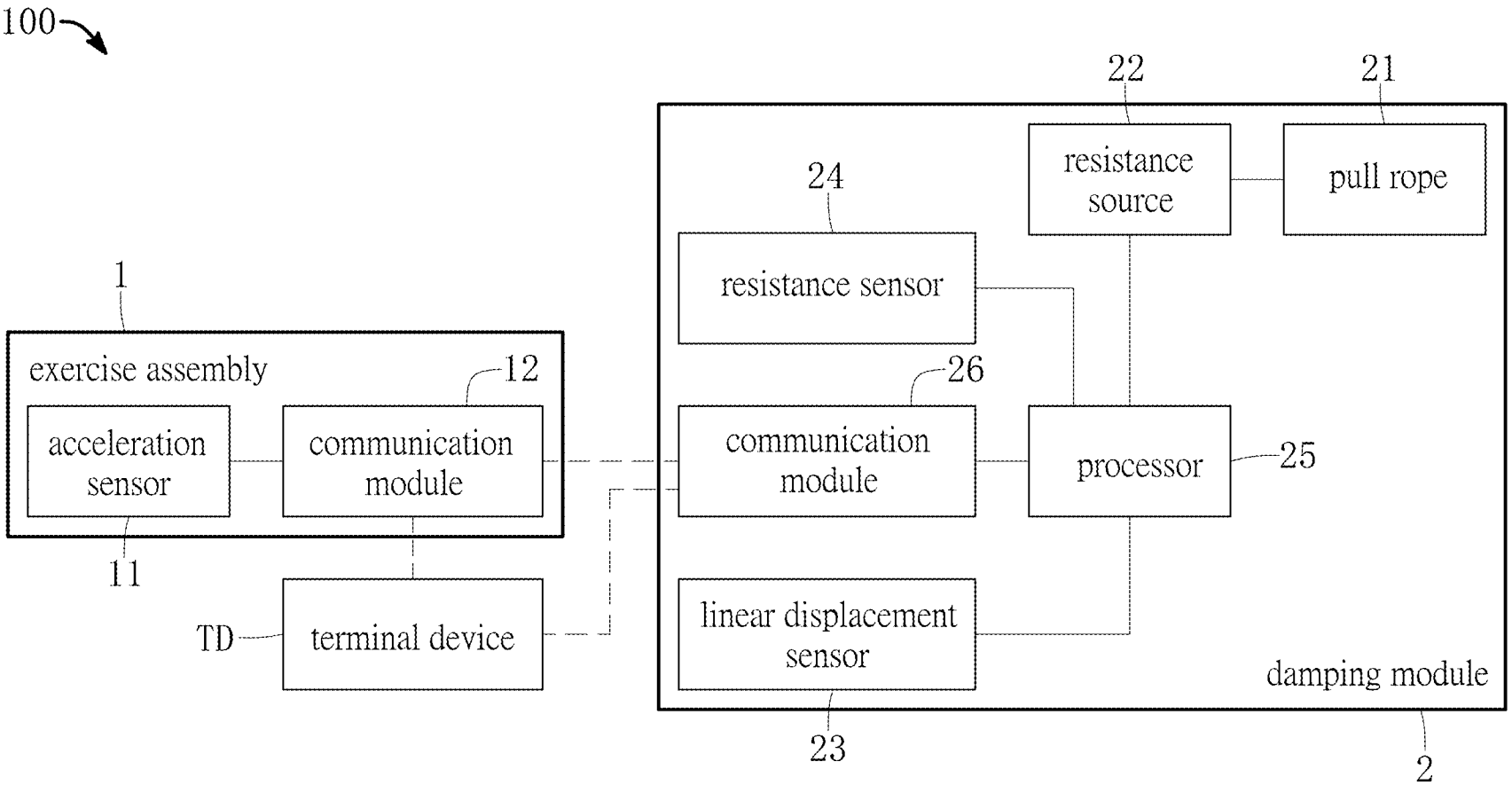
FIG. 1 is a block diagram of a fitness device according to an embodiment of the present disclosure.

Referring to FIG. 1 to FIG. 7, a first embodiment of the present disclosure provides a fitness device 100. The fitness device 100 is configured to allow a user to engage in fitness training. The fitness device 100 can dynamically adjust a weight training intensity during training process according to actual strength of the user, so that the user can achieve an actual fitness effect after multiple uses of the fitness device 100. In addition, the fitness device 100 is configured to emit a warning in a timely manner according to a training status of the user such as to prevent the infliction of sports injuries.

It should be noted that, in order to facilitate understanding of the present embodiment, the drawings of the present embodiment only show a partial structure of the fitness device 100. In this way, the structure and connection relationship of each component of the fitness device 100 can be clearly illustrated. However, the present disclosure is not limited to these drawings. The following description describes the structure and the connection relationship of each component of the fitness device 100 in the present embodiment.

As shown in FIG. 1 to FIG. 4, the fitness device 100 includes an exercise assembly 1, at least one damping module 2 that is connected to the exercise assembly 1, and a training bench 3 that is connected to the damping module 2. In the present embodiment, the exercise assembly 1 is described using a handle as an example, but the present disclosure is not limited thereto. For example, in other embodiments of the present disclosure (not shown in the drawings), when a quantity of the at least one damping module 2 is two, the exercise assembly 1 can be a bar, and two opposite ends of the bar are respectively connected to the two damping modules 2.

The exercise assembly 1 includes an acceleration sensor 11 and a communication module 12 that is electrically coupled to the acceleration sensor 11. The acceleration sensor 11 is operable to monitor a movement trajectory of the exercise assembly 1 to generate a trajectory sensing signal, and the acceleration sensor 11 is also operable to detect a movement speed of the exercise assembly to generate a speed sensing signal. The acceleration sensor 11 is configured to transmit the trajectory sensing signal and the speed sensing signal to the damping module 2 through the communication module 12.

In order to facilitate understanding of the present embodiment, the present disclosure is described with only one of the damping module 2. The damping module 2 includes a pull rope 21, a resistance source 22, a linear displacement sensor 23, a resistance sensor 24, a processor 25, and a communication module 26. One end of the pull rope 21 is connected to the exercise assembly 1. The resistance source 22 is connected to another end of the pull rope 21. The resistance source 22 is configured to output an output resistance and to control a stretching length of the pull rope 21 according to a target resistance setting value. The resistance source 22 in the present embodiment is a tension motor, but the present disclosure is not limited thereto.

The linear displacement sensor 23 is electrically coupled to the resistance source 22, and the linear displacement sensor 23 is operable to sense the stretching length of the pull rope 21 extending from the resistance source 22 to generate a linear displacement sensing signal. The resistance sensor 24 is electrically coupled to the resistance source 22, and the resistance sensor 24 is operable to sense the output resistance of the resistance source 22 to generate a resistance sensing signal.

The processor 25 is electrically coupled to the resistance source 22, the linear displacement sensor 23, and the resistance sensor 24. When the user uses the fitness device 100 to engage in weight training exercise, the processor 25 of the fitness device 100 can dynamically adjust the intensity of the weight training during the training process according to the linear displacement sensing signal and the resistance sensing signal based on the actual strength of the user.

The communication module 26 is electrically coupled to the processor 25 to transmit relevant signal from the exercise assembly 1 to the processor 25, and the communication module 26 is also configured to transmit relevant information from the processor 25 to a terminal device TD.

Figure 2:
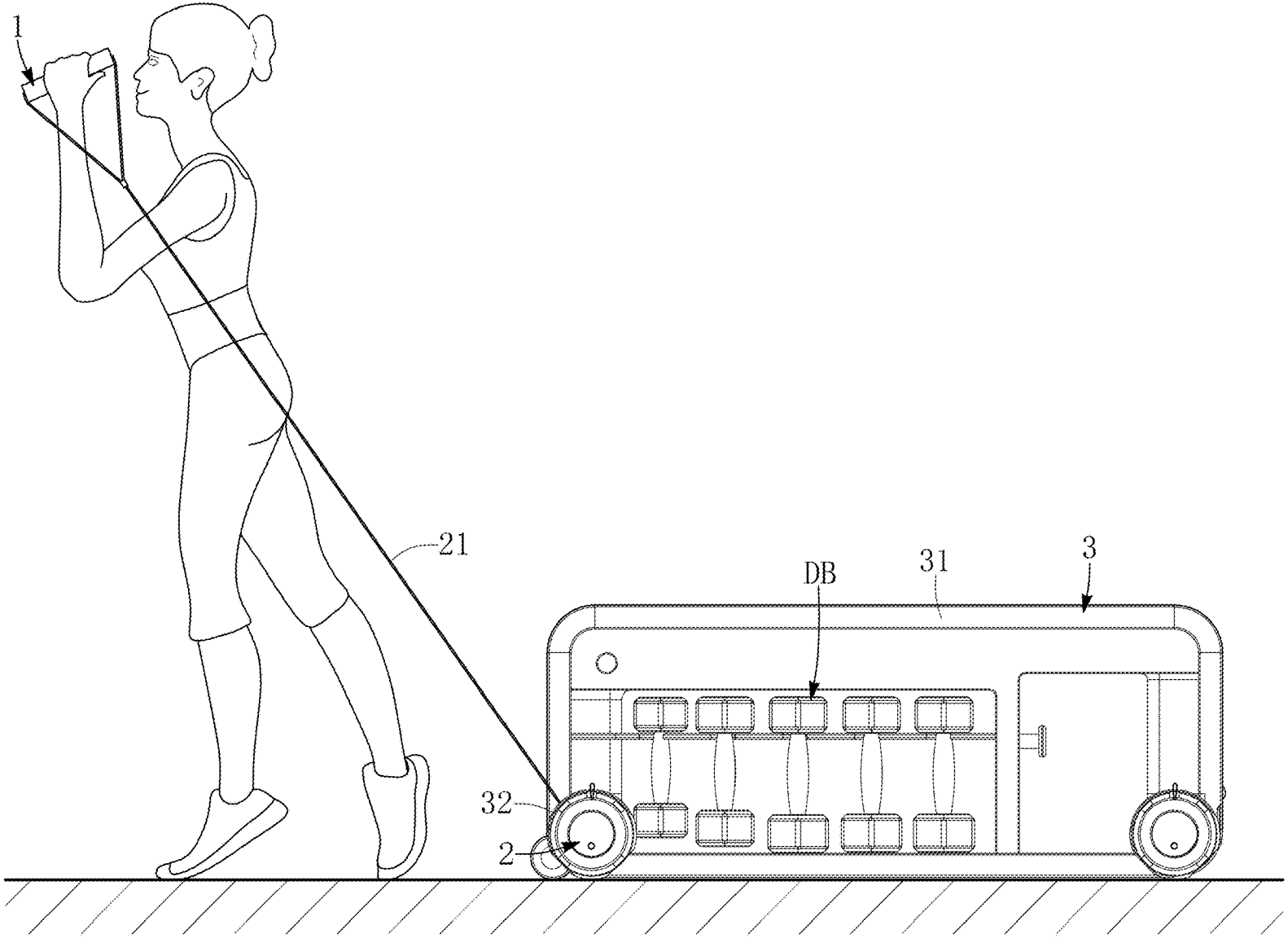
FIG. 2 is a schematic view of the fitness device in mode of use according to the embodiment of the present disclosure.
Figure 3:
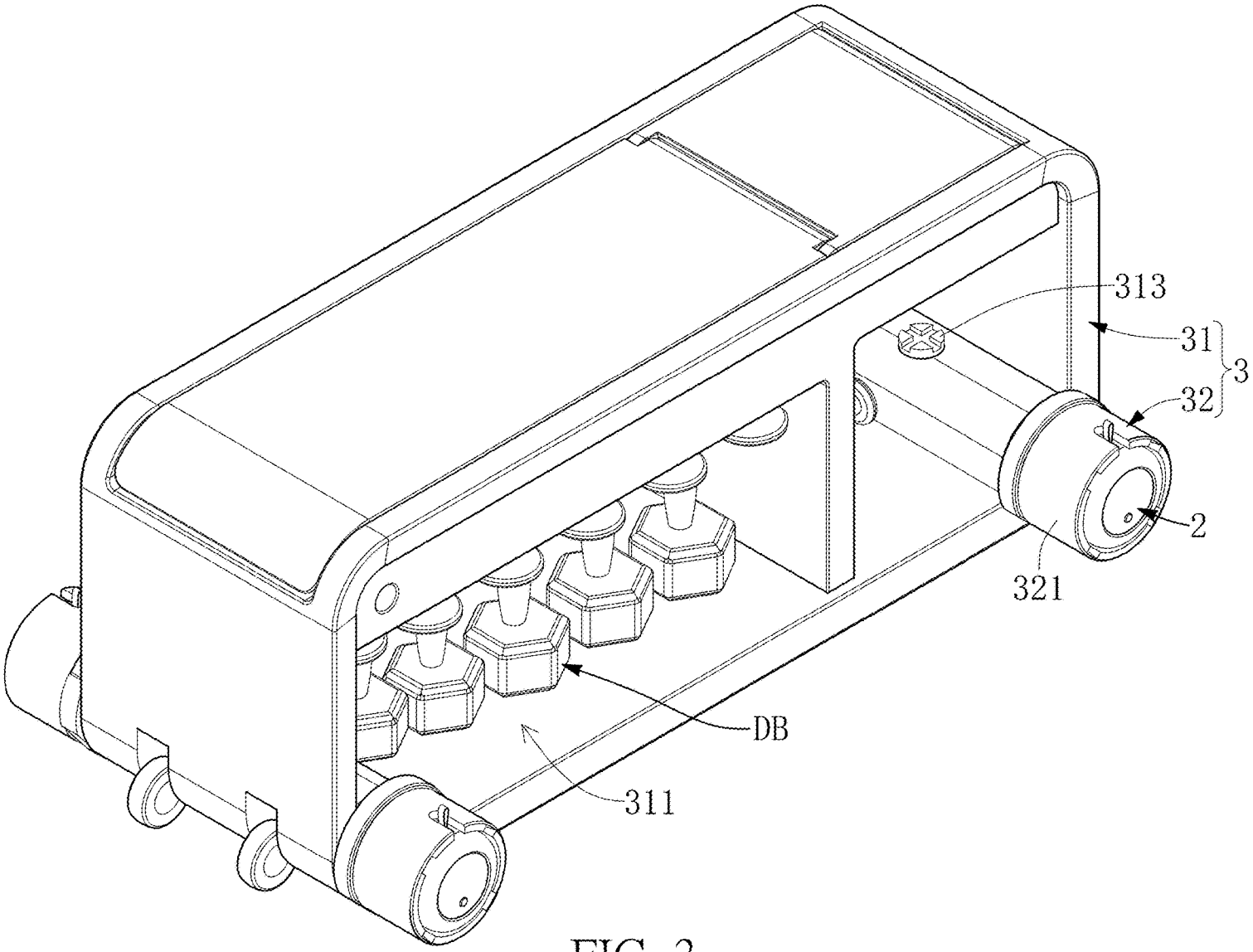
FIG. 3 is a schematic perspective view of a training bench according to the embodiment of the present disclosure.
Figure 4:
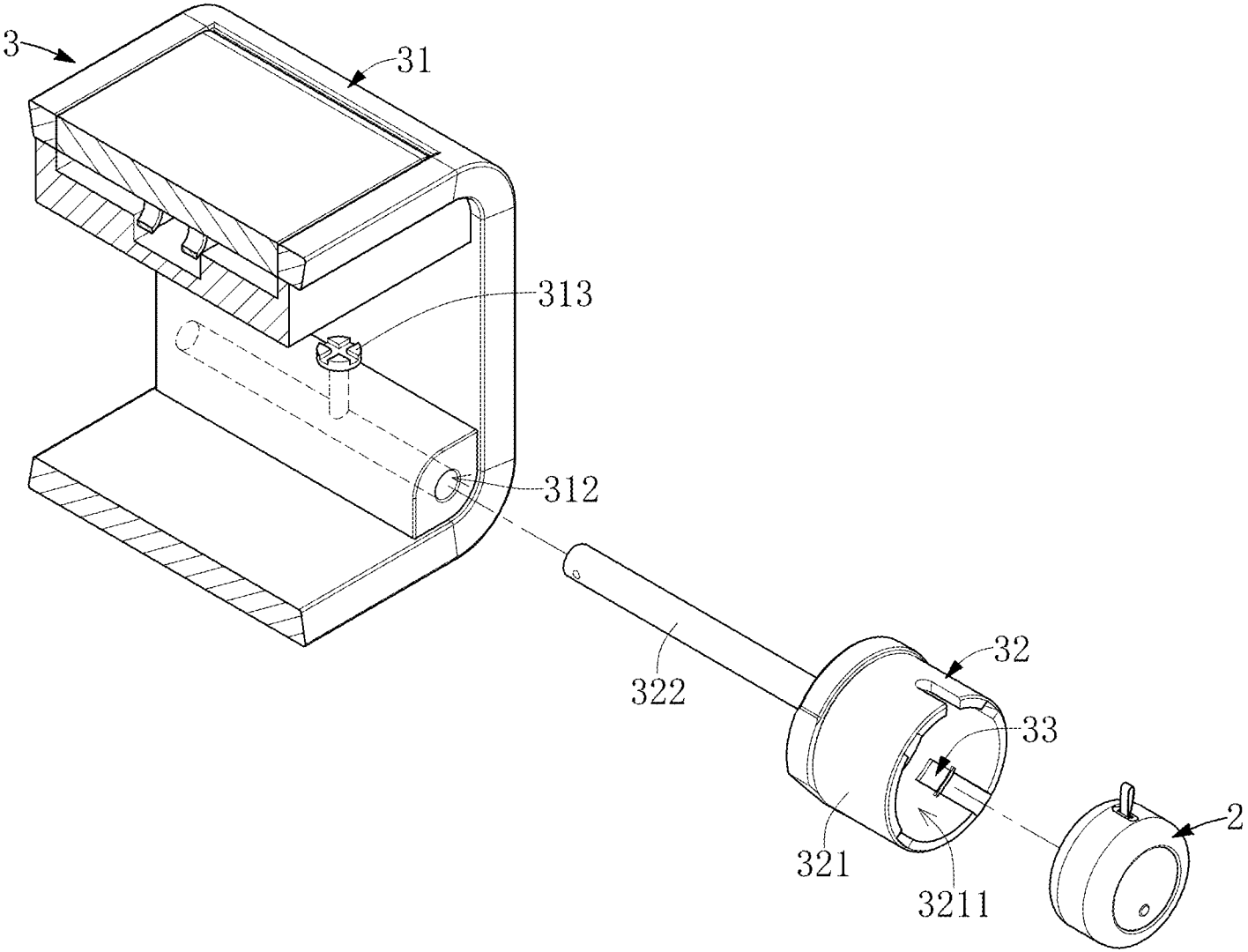
FIG. 4 is a schematic perspective view of an accommodating structure separated from a main body according to the first embodiment of the present disclosure.

As shown in FIG. 2 and FIG. 3, the training bench 3 includes a main body 31 and at least one accommodating structure 32. A shape of the main body 31 is a rectangular cuboid. An accommodating space 311 is formed inside the main body 31 and is configured to store a dumbbell DB. In the present embodiment, the main body 31 includes at least one opening 312 disposed on at least one side thereof. Preferably, each of the two sides of the main body 31 includes at least one opening 312. Each side of main body 31 can include one, two, or three openings 312. In the present embodiment, each of the two sides of main body 31 includes three openings 312, which are respectively arranged at three corners. The openings 312 can be round holes or holes of other shapes. Each side of the openings 312 includes the fixing mechanism 313 that can be a fixing screw.

The accommodating structure 32 includes a fixing sleeve 321 and a rod body 322. A shape of the rod body 322 can be circular or in other shapes, and the shape of the rod body 322 corresponds to a shape of the openings 312. The fixing sleeve 321 is connected to one end of the rod body 322, the fixing sleeve 321 can be a circular sleeve body, the fixing sleeve 321 has a fixing hole 3211 that includes a latch structure 33, and the latch structure 33 can be a hook or other component, and one or more of the latch structures 33 can be disposed in fixing hole 3211. The damping module 2 can be disposed in the fixing hole 3211 and is secured and fixed by the latch structures 33, so that the damping module 2 is stably disposed in the fixing sleeve 321, but the present disclosure is not limited thereto. In other embodiments of the present disclosure not shown in the drawings, for example, the training bench 3 can be adjusted, changed or omitted according to design requirements.

Figure 5:
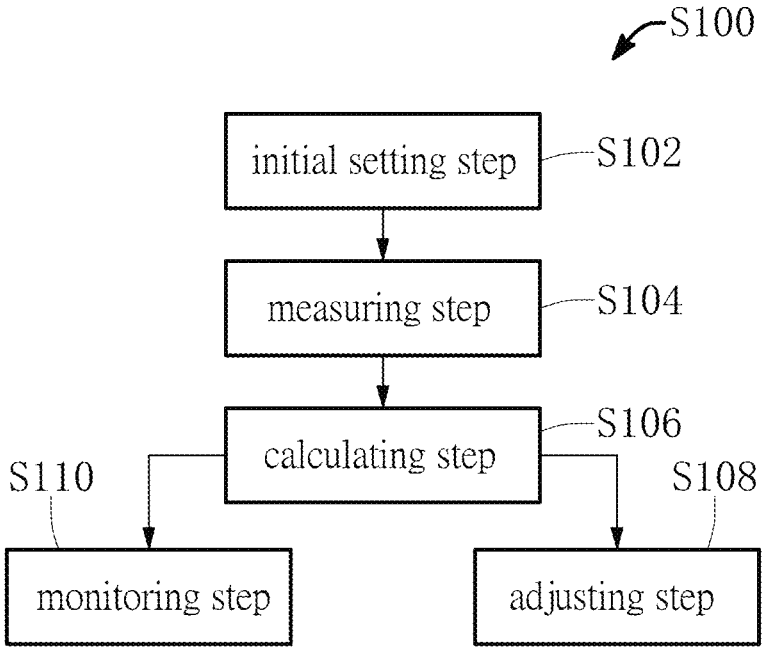
FIG. 5 is a flowchart of a resistance adjustment method of the fitness device according to the embodiment of the present disclosure.

The above is an introduction to the components and their connection relationships of the fitness device 100. Next, an adjustment method of the fitness device 100 is introduced below. That is, the adjustment method of the fitness device 100 is a resistance adjustment method of the fitness device 100. The resistance adjustment method S100 of the fitness device is an application of the fitness device 100, but the present disclosure is not limited thereto. As shown in FIG. 5, the resistance adjustment method S100 of the fitness device includes step S102 to step S110, and any one of the above steps can be omitted or replaced by reasonable variations according to practical requirements.

The resistance adjustment method S100 of the fitness device in the present disclosure includes (or sequentially implements) an initial setting step S102, a measuring step S104, a calculating step S106, and an adjusting step S108. In order to facilitate understanding of the present embodiment, the following description will first describe respective contents of the initial setting step S102, the measuring step S104, the calculating step S106, and the adjusting step S108, and introduce the corresponding component operation relationship in each of the above steps, but the present disclosure is not limited thereto.

It should be noted that, as shown in FIG. 2 and FIG. 3, the present embodiment is described by assuming that the user uses the fitness device 100 with one hand. Specifically speaking, the damping module 2 is fixed on the training bench 3, but the present disclosure is not limited thereto. In other embodiments of the present disclosure not shown in the drawings, for example, the damping module 2 can also be fixed on the ground, and the user holds the exercise assembly 1 with one hand to perform stretching movements, but the present disclosure is not limited thereto.

In the initial setting step S102, the resistance source 22 is operated to output the output resistance from small to large in sequence, and the processor 25 is configured to obtain the target resistance setting value according to the resistance sensing signal and the linear displacement sensing signal.

For example, the resistance source 22 is set during the initial setup period (e.g., 5 minutes), the resistance source 22 is operated to output the output resistance from small to large in sequence, the user holds the exercise assembly 1 and continuously performs stretching exercises to determine the resistance that the user can pull and the stretching length of the pull rope 21, thereby determining the target resistance setting value of the user and a target stretching length of the user, but the present disclosure is not limited thereto.

More specifically, since each user has a different level of strength, the user needs to perform the initial setting step S102 when using the fitness device 100 of the present embodiment for the first time, but the present disclosure is not limited thereto. For example, advanced users generally know their own strength and can directly set the target resistance setting value of the resistance source 22 without performing the initial setting step S102. Therefore, the initial setting step S102 can be adjusted or omitted according to requirements of the user.

In the measuring step S104, during a fitness training process of the user, the linear displacement sensing unit 23 is operated to sense the stretching length of the pull rope 21 and to generate the linear displacement sending signal, and the resistance sensor 24 is operated to sense the output resistance of the resistance source 22 to generate a resistance sensing signal. More specifically, each time the user stretches the pull rope 21 of the damping module 2, the linear displacement sensing unit 23 and the resistance source 22 are respectively operated to detect and generate the linear displacement sensing signal and the resistance sensing signal, and the linear displacement sensing unit 23 and the resistance source 22 are respectively operated to transmit the linear displacement sensing signal and the resistance sensing signal to the processor 25, such that the processor 25 obtains the resistance of the pull rope 21 and the stretching length of the pull rope 21 stretched out each time by the user.

In the calculating step S106, the processor 25 is operated to calculate an exercise frequency according to the linear displacement sensing signal and the resistance sensing signal. More specifically, when the user stretches the pull rope 21 of the damping module 2 multiple times, the processor 25 is configured to obtain the number of times that the user stretches the pull rope 21 within a period of time according to the linear displacement sensing signal and the resistance sensing signal, and calculate the exercise frequency.

It should be noted that, each time the user stretches the pull rope 21 of the damping module 2, the processor 25 determines from the linear displacement sensing signal and the resistance sensing signal that the resistance stretched by the user must exceed the target resistance setting value, and the stretching length of the pull rope 21 must exceed the target stretching length in order for the processor 25 to count that the user has completed one stretch of the pull rope 21 of the damping module 2.

In the adjusting step S108, the processor 25 is configured to compare the exercise frequency and a predetermined exercise frequency to control the output resistance of the resistance source 22. For example, when the predetermined exercise frequency is set to 25 and the exercise frequency of the user mostly exceeds 25 (e.g., the exercise frequency of the user exceeds 25 in 3 out of 5 times), the processor 25 is configured to control the resistance source 22 to increase the output resistance. Conversely, the processor 25 is configured to control the resistance source 22 to decrease the output resistance, but the present disclosure is not limited thereto.

In another embodiment of the present disclosure, in the calculating step S106 and the adjusting step S108, the processor 25 is operated to perform a proportional-integral-derivative (PID) control procedure according to the linear displacement sensing signal, the resistance sensing signal, and the target resistance setting value to adjust the output resistance level of the resistance source.

More specifically, it can be understood from the proportional-integral-derivative control formula (as shown in Equation (1)), u (t) is the target resistance setting value, e is a difference between the resistance corresponding to the resistance sensing signal and the target resistance setting value and a difference between the stretching length corresponding to the linear displacement sensing signal and the target stretching length, and $K_p$, $K_i$, and $K_d$ are adaptation parameters.

$$u(t) = K_P e(t) + K_i \int_0^t e(\tau)d\tau + K_d \frac{d}{dt} e(t) \tag{1}$$

In summary, the processor 25 is configured to dynamically adjust the output resistance of the resistance source 22 according to the PID calculation (as shown in Equation (1)), so that the user can continuously adjust the output resistance of the resistance source 22 through the processor 25 in order to maintain the force and stretching distance within the target range (i.e., the target resistance setting value and the target stretching length), thereby avoiding overtraining or undertraining.

Figure 6:
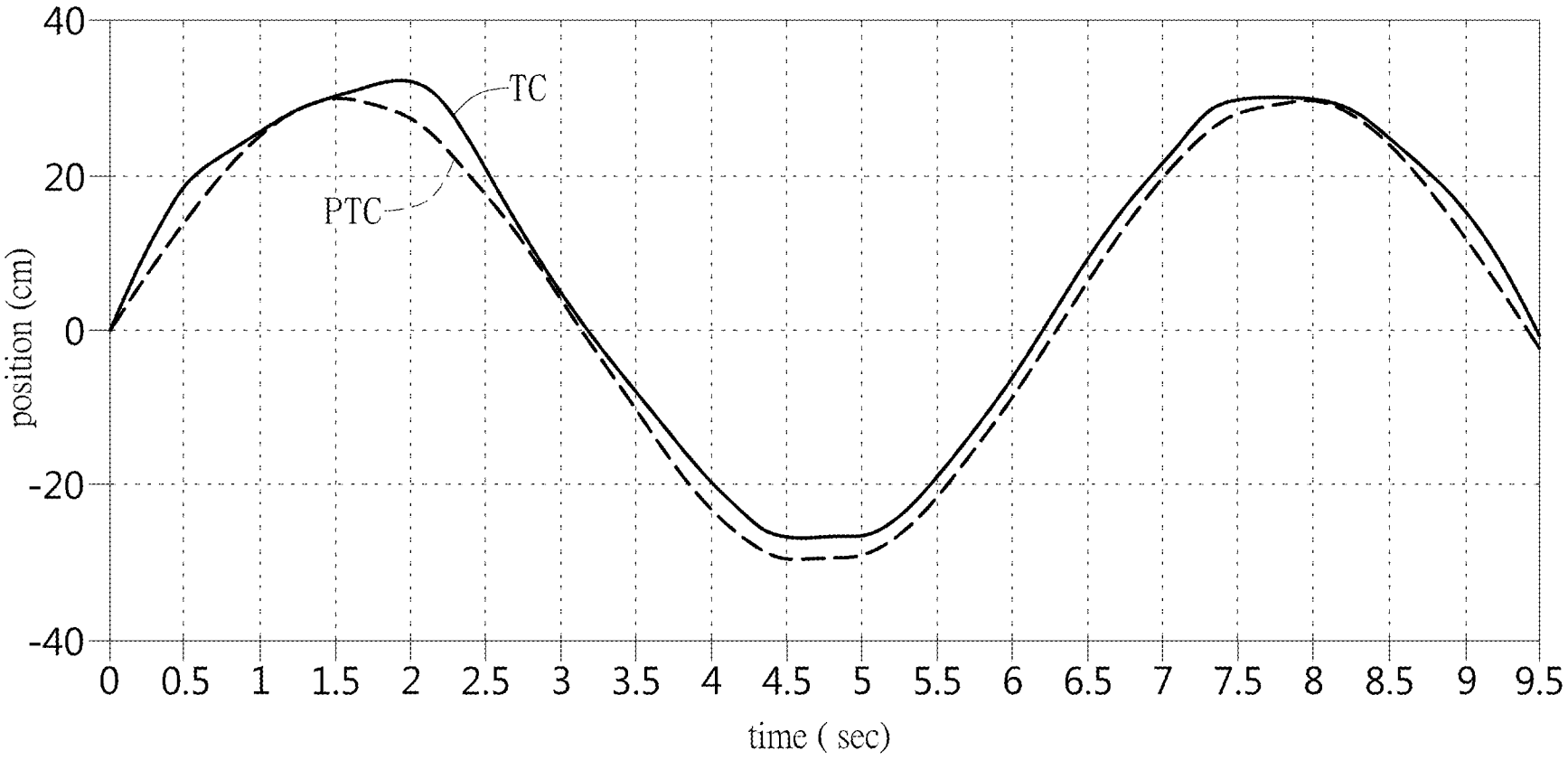
FIG. 6 is a curve diagram of a trajectory sensing signal of the fitness device according to the embodiment of the present disclosure.

In another embodiment of the present disclosure, as shown in FIG. 1, FIG. 5 and FIG. 6, the differences between the present embodiment and the above embodiment are described as follows. In the measuring step S104, the acceleration sensor 11 is operated to monitor the movement trajectory of the exercise assembly 1 to generate the trajectory sensing signal. In the calculating step S106, the processor 25 obtains an action trajectory curve TC (as shown in FIG. 6) according to the trajectory sensing signal, and the processor 25 is operated to compare a difference between the action trajectory curve TC and a predetermined trajectory curve PTC to calculate a similarity index.

More specifically, when the user completes one stretch of the pull rope 21 of the damping module 2, the processor 25 is configured to create one action trajectory curve TC similar to a sine wave according to the trajectory sensing signal. At this time, the processor 25 is built in the predetermined trajectory curve PTC corresponding to an ideal fitness action, and the processor 25 compares the difference between the action trajectory curve TC and the predetermined trajectory curve PTC to calculate the similarity index.

It should be noted that, the processor 25 is configured to calculate the similarity index by comparing the difference between the action trajectory curve TC and the predetermined trajectory curve PTC according to a dynamic time warping (DTW) algorithm.

Specifically speaking, the processor 25 is operated to compare a sum of the differences between the action trajectory curve TC and the predetermined trajectory curve PTC to determine the similarity index. In other words, the smaller the difference between the action trajectory curve TC and the predetermined trajectory curve PTC, the higher the similarity index, and the more accurately it corresponds to the fitness action of the user. Conversely, the greater the difference between the action trajectory curve TC and the predetermined trajectory curve PTC, the lower the similarity index, and the less accurate the corresponding fitness action of the user.

The present embodiment further includes a monitoring step S110 (as shown in FIG. 5) after the calculating step S106, in the monitoring step S110, when the processor 25 is configured to determine that the similarity index is lower than a predetermined proximity threshold, the processor 25 is operated to emit a first warning message. More specifically, when the similarity index is lower than a predetermined proximity threshold, it means that the fitness action of the user is so uncertain that it may cause sports injuries, and the processor 25 is operated to emit the warning to notify the user to stop training and correct his posture.

Furthermore, another embodiment of the present disclosure in the monitoring step S110, when the acceleration sensor 11 is operated to detect that a movement speed of the exercise assembly 1 exceeds a first speed threshold, the processor 25 is configured to emit a second warning message. More specifically, the movement speed of the exercise assembly 1 exceeds the first speed threshold, it means that exercise frequency of the user is too fast and may cause sports injuries. The processor 25 is operated to emit the warning to notify the user to proceed with caution.

Figure 7:
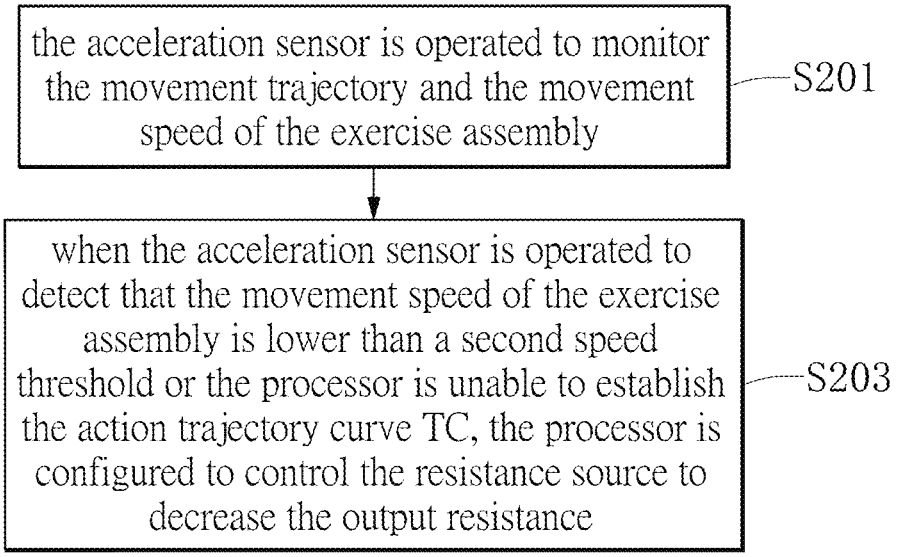
FIG. 7 is a flowchart of a monitoring step according to the embodiment of the present disclosure.

As shown in FIG. 7, the acceleration sensor 11 is operated to monitor the movement trajectory and the movement speed of the exercise assembly 1 (as shown in step S201), when the acceleration sensor 11 is operated to detect that the movement speed of the exercise assembly 1 is lower than a second speed threshold or the processor 25 is unable to establish the action trajectory curve TC, the processor 25 is configured to control the resistance source 22 to decrease the output resistance (as shown in step 203).

More specifically, when the acceleration sensor 11 is operated to detect that the movement speed of the exercise assembly 1 is lower than a second speed threshold or the processor 25 is unable to establish the action trajectory curve TC, it indicates that muscle strength of the user is fatigued and unable to sustain the current training intensity. At this time, the output resistance of the resistance source 22 is decreased to avoid sports injuries to the user.

In conclusion, in the fitness device and resistance adjustment method thereof provided by the present disclosure, the linear displacement sensor, the resistance sensor and the processor enable the fitness device to dynamically adjust the intensity of weight training during the training process according to the actual strength of the user.

What is claimed is:

1. A fitness device, comprising:

an exercise assembly; and at least one damping module connected to the exercise assembly; wherein the at least one damping module includes:

a pull rope, wherein one end of the pull rope is connected to the exercise assembly;

a resistance source connected to another end of the pull rope; wherein the resistance source is configured to output an output resistance and to control a stretching length of the pull rope according to a target resistance setting value;

a linear displacement sensor electrically coupled to the resistance source; wherein the linear displacement sensor is operable to sense the stretching length of the pull rope to generate a linear displacement sensing signal;

a resistance sensor electrically coupled to the resistance source; wherein the resistance sensor is operable to sense the output resistance of the resistance source to generate a resistance sensing signal; and a processor electrically coupled to the resistance source, the linear displacement sensor, and the resistance sensor, wherein the processor is operable to calculate an exercise frequency according to the linear displacement sensing signal and the resistance sensing signal, and the processor is operable to compare the exercise frequency and a predetermined exercise frequency to control the output resistance of the resistance source;

wherein, when the resistance source is operated to output the output resistance from small to large in sequence, the processor is configured to obtain the target resistance setting value according to the resistance sensing signal and the linear displacement sensing signal.

2. The fitness device according to claim 1, wherein the processor is operable to perform a Proportional-Integral-Derivative (PID) control procedure according to the linear displacement sensing signal, the resistance sensing signal, and the target resistance setting value to adjust an output resistance level of the resistance source.

3. The fitness device according to claim 1, wherein the exercise assembly includes an acceleration sensor that is operable to monitor a movement trajectory of the exercise assembly to generate a trajectory sensing signal, wherein the processor obtains an action trajectory curve according to the trajectory sensing signal, and the processor is operable to compare a difference between the action trajectory curve and a predetermined trajectory curve to calculate a similarity index, wherein, when the processor is configured to determine that the similarity index is lower than a predetermined proximity threshold, the processor is operated to emit a first warning message; and wherein, when the acceleration sensor is operated to detect that a movement speed of the exercise assembly exceeds a first speed threshold, the processor is configured to emit a second warning message; and, when the acceleration sensor is operated to detect that the movement speed of the exercise assembly is lower than a second speed threshold, the processor is configured to control the resistance source to decrease the output resistance.

4. The fitness device according to claim 3, wherein the processor is configured to calculate the similarity index by comparing the difference between the action trajectory curve and the predetermined trajectory curve according to a Dynamic Time Warping (DTW) algorithm.

5. The fitness device according to claim 1, wherein the fitness device further includes:

a main body; and at least one accommodating structure including a fixing sleeve and a rod body; wherein the fixing sleeve is connected to one end of the rod body, and the fixing sleeve includes a fixing hole configured to accommodate the at least one damping module.

6. The fitness device according to claim 5, wherein the rod body of the at least one accommodating structure is configured to be inserted into an opening of the main body and to be fixed by a fixing mechanism.

7. The fitness device according to claim 5, wherein at least one latch structure is disposed in the fixing hole, and wherein, when the at least one damping module is placed in the fixing hole, the at least one damping module is secured by the at least one latch structure.

8. A resistance adjustment method of a fitness device, wherein the fitness device includes an exercise assembly and at least one damping module that is connected to the exercise assembly; wherein the at least one damping module includes a pull rope, a resistance source that is connected to the pull rope, a linear displacement sensor that is electrically coupled to the resistance source, a resistance sensor that is electrically coupled to the resistance source, and a processor that is electrically coupled to the resistance source, the linear displacement sensor, and the resistance sensor; and wherein the resistance source is configured to output an output resistance and to control a stretching length of the pull rope according to a target resistance setting value, the resistance adjustment method including the following steps:

a measuring step that is implemented to sense the stretching length of the pull rope to generate a linear displacement sensing signal by the linear displacement sensor and that is implemented to sense the output resistance of the resistance source to generate a resistance sensing signal by the resistance sensor;

a calculating step that is implemented to calculate an exercise frequency according to the linear displacement sensing signal and the resistance sensing signal by the processor;

an adjusting step that is implemented to compare the exercise frequency and a predetermined exercise frequency to control the output resistance of the resistance source by the processor; and an initial setting step before the measuring step, wherein, in the initial setting step, the resistance source is operated to output the output resistance from small to large in sequence, and the processor is configured to obtain the target resistance setting value according to the resistance sensing signal and the linear displacement sensing signal.

9. The resistance adjustment method of the fitness device according to claim 8, wherein the exercise assembly includes an acceleration sensor; wherein, in the measuring step, the acceleration sensor is operated to monitor a movement trajectory of the exercise assembly to generate a trajectory sensing signal; wherein, in the calculating step, the processor obtains an action trajectory curve according to the trajectory sensing signal, and the processor is operated to compare a difference between the action trajectory curve and a predetermined trajectory curve to calculate a similarity index; and wherein, after the calculating step, a monitoring step is further included, in the monitoring step, when the processor is configured to determine that the similarity index is lower than a predetermined proximity threshold, the processor is operated to emit a first warning message; when the acceleration sensor is operated to detect that a movement speed of the exercise assembly exceeds a first speed threshold, the processor is configured to emit a second warning message; and, when the acceleration sensor is operated to detect that the movement speed of the exercise assembly is lower than a second speed threshold, the processor is configured to control the resistance source to decrease the output resistance.

10. The resistance adjustment method of the fitness device according to claim 9, wherein, in the calculating step, the processor is configured to calculate the similarity index by comparing the difference between the action trajectory curve and the predetermined trajectory curve according to a Dynamic Time Warping (DTW) algorithm.

11. The resistance adjustment method of the fitness device according to claim 8, wherein, in the adjusting step, the processor is operated to perform a Proportional-Integral-Derivative (PID) control procedure according to the linear displacement sensing signal, the resistance sensing signal, and the target resistance setting value to adjust an output resistance level of the resistance source.

* * * * *